United States Patent [19]

Bruskin

[11] 4,262,042

[45] Apr. 14, 1981

[54] METHOD OF PRODUCING A PICTURE

[76] Inventor: Boris Bruskin, 3154 Coney Island Ave., Apt. 1C, Brooklyn, N.Y. 11235

[21] Appl. No.: 93,276

[22] Filed: Nov. 13, 1979

[51] Int. Cl.[3] ..... B05D 3/12

[52] U.S. Cl. ..... 427/275; 427/277

[58] Field of Search ..... 427/275, 277, 165, 266, 427/269, 264, 270, 260; 156/663

[56] References Cited

U.S. PATENT DOCUMENTS

| | | | |
|---|---|---|---|
| 1,490,4 07 | 4/1924 | Vallely | 427/275 X |
| 1,600,579 | 9/1926 | D'arino | 427/269 |
| 2,324,694 | 7/1943 | Gustkey | 156/663 X |

*Primary Examiner*—Evan K. Lawrence

*Attorney, Agent, or Firm*—Ilya Zborovsky

[57] ABSTRACT

A method of producing a picture includes providing a first member carrying contours of the picture to be produced, forming from the same a second member with mirror-inverted contours of the picture, placing onto the second member the front surface of a plastic member which is transparent, and producing on the rear surface of the plastic member a plurality of grooves corresponding to image regions of the picture in correspondence with the contours, painting the rear surface and filling the grooves, removing the surplus of paint so that it remains only in the grooves, and applying another paint onto the thus formed paint-free rear surface so as to form a background.

5 Claims, 4 Drawing Figures

METHOD OF PRODUCING A PICTURE

BACKGROUND OF THE INVENTION

The present invention relates to a method of producing a picture such as a painting, an advertisement article, a stained glass panel and the like. More particularly, it relates to a method which reproduces a picture from an initial carrier.

Methods of the above-mentioned general type are known in the art. A known method is performed with the utilization of a pantograph which moves along a model representing a picture 2–3 times larger, on the one hand, and also moves along a picture carrier such as paper, fabric, glass so as to produce on the latter a picture which corresponds to the picture of the model. This method posesses several disadvantages. The dimensions of the pantograph are limited, which means that the method can produce the pictures with limited dimensions. The pantograph is utilized with rotatable tools which do not provide for high quality of the picture. Clearness or sharpness of the picture is not satisfactory in many cases.

SUMMARY OF THE INVENTION

Accordingly, it is an object of the present invention to provide a method of producing a picture which avoids the disadvantages of the prior art.

More particularly, it is an object of the present invention to provide a method which enables an artist to produce a picture of unlimited dimensions with high quality.

In keeping with these objects and with others which will become apparent hereinafter, one feature of the present invention resides, briefly stated, in a method including the steps of forming a member with mirror-inverted contours of a picture, placing the front surface of a transparent plastic or organic member onto the mirror-inverted contours, producing a plurality of grooves on the reverse surface of the plastic member in correspondence with image regions of the picture, painting the reverse surface and simultaneously filling the grooves, removing the paint from the reverse surface in the regions surrounding the grooves, and painting these surrounding regions by another paint so as to form a background.

When a picture is so produced in accordance with the inventive method, there are no limitations as to the dimensions of the picture, the latter is produced with high quality including high clearness or sharpness. Moreover, a picture with unlimited number of colors may be produced.

In accordance with another feature of the present invention, simultaneously with removing of the paint from the reverse side in the regions surrounding the image regions, a thin layer of the plastic or organic member is also removed from the reverse surface of the member in these regions. In this case, the paint is removed better, on the one hand. On the other hand, when the surface layer of the plastic or organic glass is also removed, the thus-produced uncovered rough surface has better characteristics for subsequent painting of a background in the sence of improved adhesion of the paint to the surface.

Still another feature of the present invention is that the background is painted on the reverse surface of the plastic or organic member simultaneously with painting of additional regions whose color corresponds to the color of the background.

The novel features which are considered as characteristic for the present invention are set forth in particular in the appended claims. The invention itself, however, both as to its constructions and methods of performance will be better understood from the following description when taken with the accompanying drawings.

DESCRIPTION OF A PREFERRED EMBODIMENT

Figure 1:
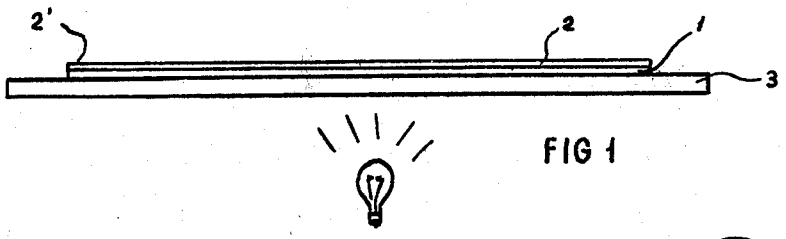
FIG. 1 is a view showing the step of forming a mirror-inverted contour of a picture, in accordance with the present invention.
Figure 2:
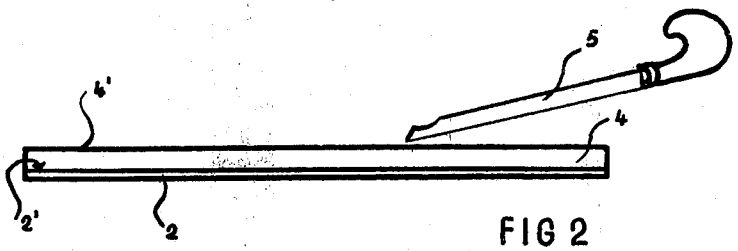
FIG. 2 is a view showing producing a plurality of grooves on a reverse surface of a transparent plastic or organic member, in accordance with the present invention.
Figure 3:
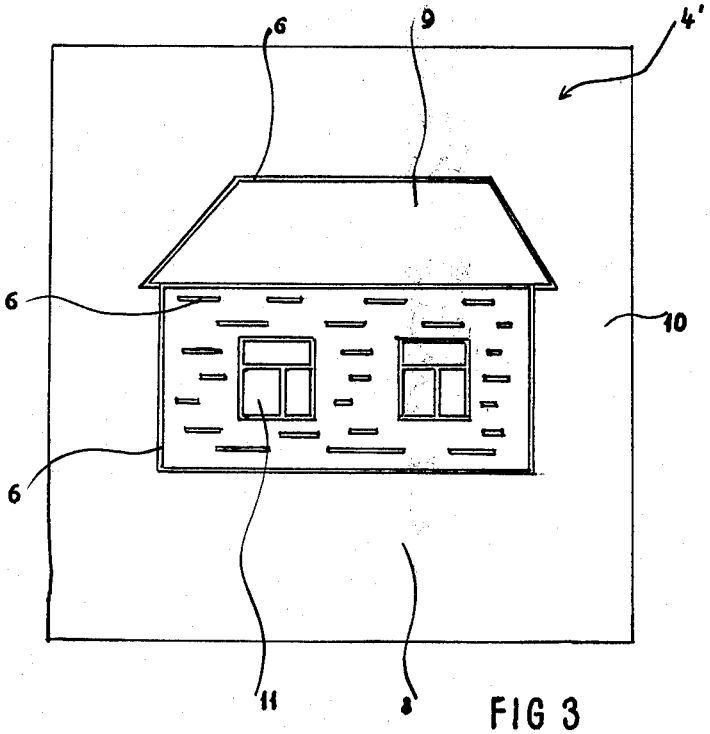
FIG. 3 is a view showing the reverse surface of the plastic or organic member, in accordance with the present invention.

In order to produce a picture in accordance with the present invention, a sketch is first formed which carries contours of the picture to be produced. This sketch may be drawn, for example, on a sheet of paper 1.

A member 2 carrying mirror-inverted contours of the picture is then made. The member 2 can be made in the following manner. The sheet of paper 1 which carries the initial contours is placed on a transparent screen 3 illuminated from the rear by a source of light, with the contour side of the paper against the screen. Then, the member 2 which may also be a sheet of paper, is placed onto the sheet of paper 1, and light penetrates through both sheet 1 and 2. An artist draws contours which appear on the sheet 2 and represent mirror-inverted image of the contours of the sheet 1. More particularly, the mirror-inverted contours are drawn on an upper surface 2' of the sheet of paper 2.

The member 2 may be produced in another manner. For example, the sheet of paper 1 with the contours of the picture is photographed, a negative is produced by this photographing and projected onto a sheet of paper, and the thus-obtained contours are drawn by an artist on the latter.

A transparent plastic or organic member 4, for example, an acrylic member, is placed onto the member 2 and so that the former faces toward the surface 2' wherein the inverted contours of the picture are provided. Grooves corresponding to these contours are formed on the opposite surface 4' of the plastic or organic member 4. These grooves are formed, for example, by a style 5.

Figure 4:
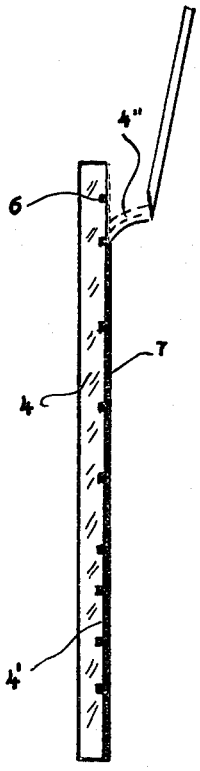
FIG. 4 is a view showing the step of removing a paint together with a surface layer of the plastic or organic member, in accordance with the present invention.

A paint 7 is then applied on the surface 4' of the member 4 so that it completely coats the surface 4' and also fills the grooves 6. Paints of different colors may be applied in the regions of different grooves 6, in dependence upon the artistic concept of the picture. Then, the surplus of paint is removed from the surface 4', for example, by a blade, so that the paint 7 remains only inside the grooves 6. It is advantageous to remove not only the paint 7, but also an upper layer 4'' of the surface 4' of the plastic or organic member 4. This is shown in dotted lines in FIG. 4.

All spots or parts of the picture surrounding the regions of the grooves 6 or the image regions, are then painted. These parts or spots are identified by reference numerals 8 and 9. They have colors which differ from the colors of the grooves and a background of the picture to be produced.

Then, above the paint located in the grooves 6 and the paints located in the regions 8 and 9, an additional paint 10 is applied onto the surface 4' so as to form a background of the picture. Some regions of the picture, such as regions 11, may have a color corresponding to the color of the background 10. In the latter case, the additional paint simultaneously appears both in the region 10 and in the regions 11.

Unlimited number of paints of different colors can be utilized in the inventive method. For example, nitric paints, acrylic lacquers and the like may be suitable for this method. The plastic or organic member may have any desirable thickness and is very strong.

It is also possible to produce a picture which is illuminated from the reverse side or from the lateral side by additional illumination means associated with the picture manufactured in accordance with the inventive method.

It will be understood that each of the elements described above may also find a useful application in other types of constructions differing from the types described above.

While the invention has been illustrated as embodied in a particular method, it is not intended to be limited to the details shown, since various modifications and structural changes may be made without departing in any way from the spirit of the present invention.

Without further analysis, the foregoing will so fully reveal the gist of the present invention, that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of producing a picture, comprising the steps of providing a first member carrying contours of a picture to be produced;

forming from said first member, a second member which carries mirror-inverted contours of the picture;

placing a transparent plastic member which has a front surface and a rear surface spaced from one another, onto said second member so that said front surface of said transparent member faces toward the mirror-inverted contours of said second member;

producing on said rear surface of said transparent member a plurality of grooves corresponding to image regions of the picture;

painting said rear surface of said transparent member so that the paint coats said rear surface and fills said grooves;

removing the paint from said rear surface of said transparent member so that said grooves remain filled by the paint whereas the remainder portion of said rear surface becomes paint-free; and applying another paint onto said paint-free remainder portion of said rear surface of said transparent member so as to form a background surrounding said image regions.

2. A method as defined in claim 1, wherein said plastic member is of acrylic.

3. A method as defined in claim 1, wherein said removing step includes simultaneously removing a thin layer of said plastic member at said rear surface thereof.

4. A method as defined in claim 1; and further comprising the step of further painting of said rear surface by a further paint at locations corresponding to further image regions which surround said first-mentioned image regions and are to have colors differing from the colors of said first-mentioned regions and of the background, said further painting step being performed after said removing step and before said applying step.

5. A method as defined in claim 1, wherein the picture has additional regions which have color corresponding to the color of the background, said applying step including applying the said another paint onto said rear surface of said plastic member also at the locations corresponding to said additional regions of the picture, simultaneously with the application of the said another paint for forming the background.

* * * * *